US006682304B2

(12) United States Patent
Beeck et al.

(10) Patent No.: US 6,682,304 B2
(45) Date of Patent: Jan. 27, 2004

(54) COOLED GAS TURBINE BLADE

(75) Inventors: Alexander Beeck, Orlando, FL (US); Reinhard Fried, Nussbaumen (CH); Markus Oehl, Waldshut-Tiengen (DE)

(73) Assignee: Alstom Technology Ltd, Baden (CH)

( * ) Notice: Subject to any disclaimer, the term of this patent is extended or adjusted under 35 U.S.C. 154(b) by 75 days.

(21) Appl. No.: 09/996,684

(22) Filed: Nov. 30, 2001

(65) Prior Publication Data

US 2002/0127103 A1 Sep. 12, 2002

(51) Int. Cl.[7] ..... F01D 5/08; F01D 5/18
(52) U.S. Cl. ..... 416/96 R; 416/189
(58) Field of Search ..... 416/2, 95, 96 R, 416/181, 189, 204 A, 213 R, 248; 415/173.6

(56) References Cited

U.S. PATENT DOCUMENTS 2,920,865 A * 1/1960 Lombard ..... 416/95 X
4,017,209 A 4/1977 Bodman
5,350,277 A * 9/1994 Jacala et al. ..... 416/95 X
6,454,526 B1 * 9/2002 Cunha et al. ..... 415/115

FOREIGN PATENT DOCUMENTS

EP 0 928 880 7/1999
JP 08028303 1/1996

* cited by examiner

*Primary Examiner*—Edward K. Look
*Assistant Examiner*—Richard A. Edgar
(74) *Attorney, Agent, or Firm*—Burns, Doane, Swecker & Mathis, L.L.P.

(57) ABSTRACT

A cooled gas turbine blade with a shroud in which a cooling channel system is provided, which is closed off radially to the gas turbine blade with a cover plate is characterized in that the cover plate has a circumferential edge, along the entire extension of which the cover plate enters into a continuous shape-mated connection or a plurality of locally limited shape-mated connections with the shroud.

13 Claims, 6 Drawing Sheets

COOLED GAS TURBINE BLADE

FIELD OF THE INVENTION

The invention relates to a cooled gas turbine blade with a shroud in which a cooling channel system is provided, which is closed off radially to the gas turbine blade with a cover plate.

BACKGROUND OF THE INVENTION

In an effort to increase the efficiency of turbine power machines, in particular of gas turbine systems, the achieving of the highest possible combustion temperatures plays an especially important role, in particular since this allows a direct optimization of the thermal efficiency of the combustion process. High combustion temperatures have the result, however, that the gas turbine components exposed to the hot gases generated during the combustion process are also subject to extremely high thermal loads on the material. The latter, at the same time, constitute the current technical limits for a potential further increase of the combustion temperatures, especially since the temperatures that can be achieved inside the combustor are far above the thermal load limits of those materials of which the gas turbine components in the hot channel of the gas turbine are made, most of all the gas turbine blades.

In order to be able to nevertheless increase the thermal load limits of the system components in the hot gas channel, in spite of existing, material-specific maximum temperatures, the heat-exposed system components are actively cooled by means of a targeted supply of cooling air by providing corresponding cooling channel systems.

As already mentioned above, the gas turbine blades positioned downstream from the combustor require, as a result of the high thermal load, highly effective cooling measures in order to not exceed the material-specific temperature limits necessary for continuous operation inside the blade arrangements.

In an actually known manner, gas turbine blades, regardless of whether they are rotating or guide blades, usually consist of a blade root and a blade hub, where in most cases a shroud projects radially over the blade hub. The cooling system provided inside a gas turbine blade usually consists of a plurality of individual cooling channels that extend from the sides of the blade roots radially through the entire turbine blade up to the shroud. Within the shroud, cooling channel areas are provided, in which flow guidance structures for removing and deflecting cooling air are provided in order to improve the cooling effect inside the shroud.

For reasons resulting from the casting process during the blade production, a turbine blade existing as a semi-finished product following the casting process and the removal of the casting core that produces, among other things, the cooling channels, is provided in particular in the area of the shroud with large openings that permit a later insertion of the previously mentioned flow guidance structures, for example an impact cooling plate, which must be sealed, however, so as to be gas-tight. For this purpose, a closing plate or so-called cover plate, which is largely adapted to the opening contour, is used, said closing plate usually being connected with the shroud of the gas turbine blade by way of high-temperature soldering.

FIGS. 2*a* to 2*c* illustrate an actually known connection between a cover plate 6 and the shroud 2 of a turbine blade. FIG. 2*a* shows a perspectival illustration of a turbine blade with a blade hub 1 and a shroud 2. The shroud 2 has two side edges 4 and 5, each of which is constructed with a groove contour 3, along which a cover plate 6 is inserted in a shape-mated manner. The cross-section according to section line S1 is shown in FIG. 2*b*. The groove contour 3 partially covers the cover plate 5 inserted into the shroud 2, said cover plate being fixed, in addition to the shaped-mating between the groove contour 3 and the cover plate 6 by way of a soldering connection 7. The cross-section illustration according to FIG. 2*b* shows the cooling channels K enclosed between the cover plate 6 and the shroud 2, through which cooling channels the cooling air is fed through the cooling system (not shown in further detail) inside the gas turbine blade.

If a break inside the soldering joint (7) occurs along the joint connection that is shape-mated and incorporated into the material along the side edges 4 and 5, the cover plate 6 along side edge 4 is unable to detach because of the existing shape-mating of the shroud 2. The situation is different, though, along the front and backside edges 8 and 9 in FIG. 2*a*, the associated section of which side edges along section line S2 is illustrated in FIG. 2*c*. Along the side edges 8 and 9, the cover plate 6 is joined with the shroud 2 only by a soldering connection 7 by way of a metallurgical joint. There is no additional shape-mating in this case. If, however, tears occur inside the soldering joint 7 in the area of this joint connection as a result of the high thermal loads, as well as mechanical deformation created during the operation of a gas turbine, this inevitably results in local detachments between the cover plate 6 and the shroud 2, which finally lead to the total loss of the cover plate 6. Such a cover plate loss leads to catastrophic damage in the gas turbine system, however, which requires the system to be stopped in order to be able to perform extensive repair work.

SUMMARY OF THE INVENTION

The invention is based on the objective of constructing a cooled gas turbine blade with a shroud in which a cooling channel system is provided that is closed off radially to the gas turbine blade in such a way that the cover plate is joined with the shroud in a secure manner, and in which the previously mentioned total loss of the cover plate can be excluded. Another objective is to decisively minimize losses due to leakage in the case of tears occurring in the joint connection between the cover plate and the shroud. The measures to be instituted hereby should require only a small expenditure for construction, which would not or would only insignificantly increase the manufacturing costs of cooled gas turbine blades.

According to the invention, a cooled gas turbine blade is constructed in such a way that the cover plate has a circumferential edge, along the entire extension of which the cover plate enters into a continuous shape-mated connection or a number of locally limited shape-mated connections with the shroud of the gas turbine blade.

Starting with the initially described state of the art according to the gas turbine blade illustrated in FIG. 2*a* ensures only a shape-mated connection between the cover plate and the shroud at two facing side edges because of the receptacle groove existing there, the objective is to also provide corresponding shape-mated connections along the other two side edges, so that the cover plate enters, if possible, a shape-mated connection with the shroud of a gas turbine blade along its entire circumferential edge.

Due to construction and assembly, this requirement cannot be fulfilled with the actually known gas turbine blade according to FIG. 2*a*, especially since the cover plate is pushed into the receptacle groove 3 sideways, longitudinally to the,side edges 4 and 5 for assembly. Any later attachment of corresponding, groove-shaped longitudinal ridges along the side edges 8 and 9 on the shroud 2 illustrated in FIG. 2*a* would decisively increase the total expenditure in the production of the gas turbine; additionally, the soldering joints needed for the attachment of such potential lateral ridges represent additional mechanical "breakaway points."

In contrast, a shroud constructed according to the invention provides a receptacle contour adapted to the shape and size of the circumferential edge in the sense of a box edge, into which the cover plate can be completely inserted radially. The receptacle contour preferably has a stepped cross-section, comparable to that of a picture frame, into which a picture can be placed from the back. The stepped cross-section of the receptacle contour hereby has radially or oblique radially-oriented a first stage surface, and axially-oriented a second stage surface, the so-called support surface, on which the cover plate can be placed with its entire circumferential edge. The directional information of radially or axially hereby refers to the usual directional information commonly used in connection with an axial flow rotor arrangement inside a gas turbine system.

Between the circumferential edge of the cover plate inserted into the receptacle contour and the radially or oblique radially-oriented first stage surface, a gap is provided into which a joining means, preferably soldering material, can be inserted. The soldering material is preferably selected so that it has no or only little ductility following the performance of the soldering and/or thermal treatment process, i.e. is brittle.

Because of thermally produced deformations, the brittleness inherent in the soldering material causes tears inside the soldering seam even at the beginning of the first operation of the gas turbine blades, which form as "zig-zag"-shaped break lines or areas and extend through the entire soldering joint. Surprisingly, it is especially these break surfaces that form which ensure a safe shape-mating and also help in creating a soldering joint free of bending stresses between the cover plate and the shroud.

The hair-line tear forming in the soldering joint basically presents a cooling air leak, through which cooling air is able to escape from the cooling air system in the gas turbine blade defined by the cover plate towards the outside; however, this cooling air loss is negligibly small and is not significant. In addition, oxidation layers form on the surfaces of the tear in the soldering joint, which oxidation layers are able to reduce, on the one hand, the gap produced by the tear, and, on the other hand, ensure a play-free seat of the cover plate in the shape-mated connection established by the soldering joint, in spite of the large vibrations occurring during the operation of the gas turbine.

Further details regarding the above described shape-mated connection, which is based on the formation of a tear in the soldering joint that completely surrounds the cover plate, are found in the further description in reference to the following exemplary embodiments.

According to the invention, alternatively to a soldering joint and a hairline tear forming in it in order to produce a seat of the cover plate free of play and bending stresses inside the shroud, a mechanical retention means that enters both into a functional connection with the shroud as well as with the cover plate is suitable.

In a simple embodiment, the first, preferably radially-oriented step surface of the receptacle contour inside the shroud for this purpose provides a circumferential mounting groove, with which the outside contour of a retainer ring that surrounds the cover plate in a suitable form is able to engage at least half-way. An insertion of the cover plate into the receptacle contour of the shroud is brought about by a mechanical tying together of the retainer ring, which, after appropriate joining inside the mounting groove is able to spread in the shroud and in this way ensures a shape-mated connection between the shroud and the cover plate. Alternatively to the use of a retainer ring, rod-shaped retention means can also be used to create a shape-mated connection between the cover plate and the shroud by inserting them through suitable holes in the cover plate and the shroud. The rod-shaped retention means may be inserted in corresponding mounting openings so as to extend tangentially or radially between the cover plate and the shroud. Although the cover plate in this way is not joined along its entire circumferential edge by means of a continuous shape-mated connection with the shroud, as is the case with a circumferential soldering joint, this method, however, also-ensures a secure seat of the cover plate in the shroud.

BRIEF DESCRIPTION OF THE DRAWINGS

The invention is described below as an example, using exemplary embodiments in reference to the drawings without limiting the general idea of the invention. Hereby.

DETAILED DESCRIPTION OF THE PREFERRED EMBODIMENTS

Figure 1:
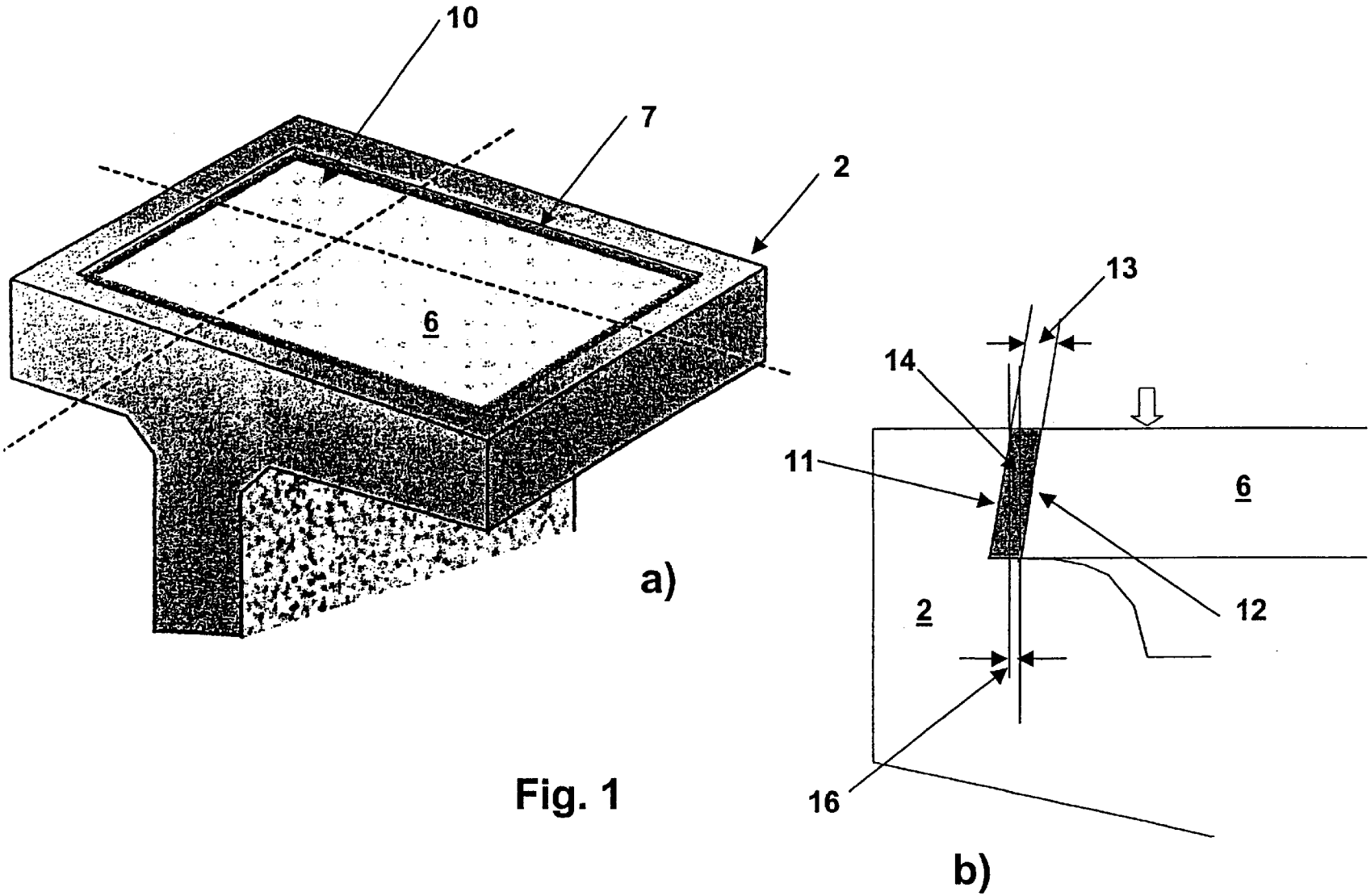
FIG. 1*a* shows a perspectival top view of a shroud with inserted cover plate.
FIG. 1*b* shows a cross-section through the receptacle contour of a shroud with inserted cover plate, FIGS. 2*a,b,c* show illustrations of a known cover plate/shroud connection (state of the art), FIGS. 3*a,b* show illustrations of the formation of a tear in the soldering joint.
Figure 2:
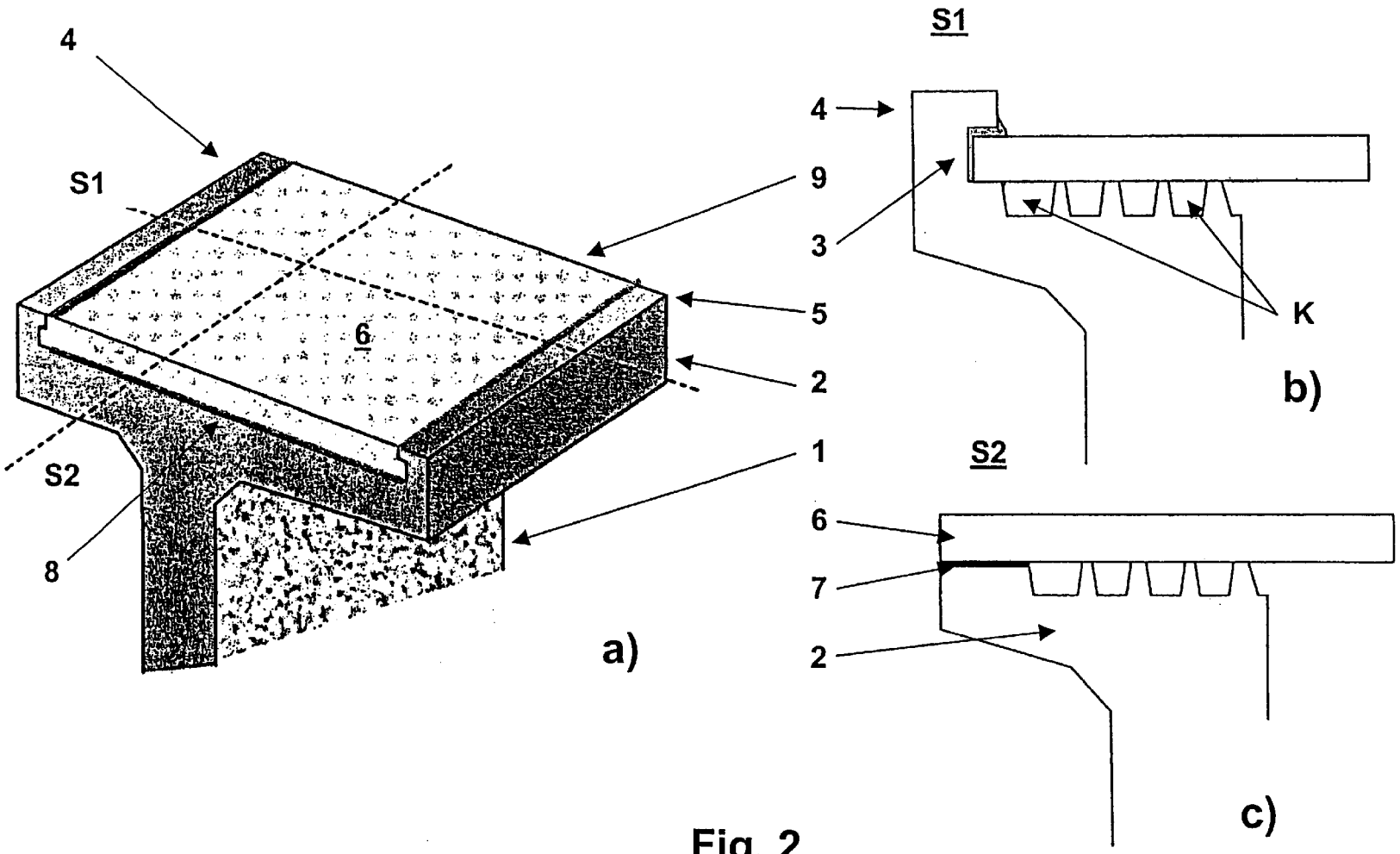
Fig. 2 PRIOR ART

FIG. 1*a* shows a perspectival top view of a gas turbine blade with a shroud 2 that is provided at its radially-oriented top side with a rectangular recess 10, into which the cover plate 6 is completely inserted radially from the top. Between the cover plate 6 and the shroud 2, a soldering joint 7 is inserted, which completely surrounds the circumferential contour of the cover plate 6.

FIG. 1*b* shows a cross-section through an optional point transversely to the receptacle contour inside the shroud 2. The receptacle contour of the shroud 2 is provided with a first, oblique radially-oriented stage surface 11, as well as an axially-oriented second stage surface, the so-called support surface 12. The depth of the stage of the receptacle contour preferably is selected just so that the surface of the cover plate 6 ends flush with surface of the shroud 2. Between the cover plate 6 and the shroud 2 a gap 13 is provided for inserting the cover plate 6, the size of said gap being selected at least so that it enables a simple insertion of the cover plate 6 into the receptacle contour of the shroud 2 based on an existing installation play 16. The gap 13 forming between the cover plate 6 and the shroud 2 is then filled completely with soldering material 14 and is soldered, whereby the soldering material 14 has the lowest possible ductility or high brittleness after the soldering process.

Figure 3:
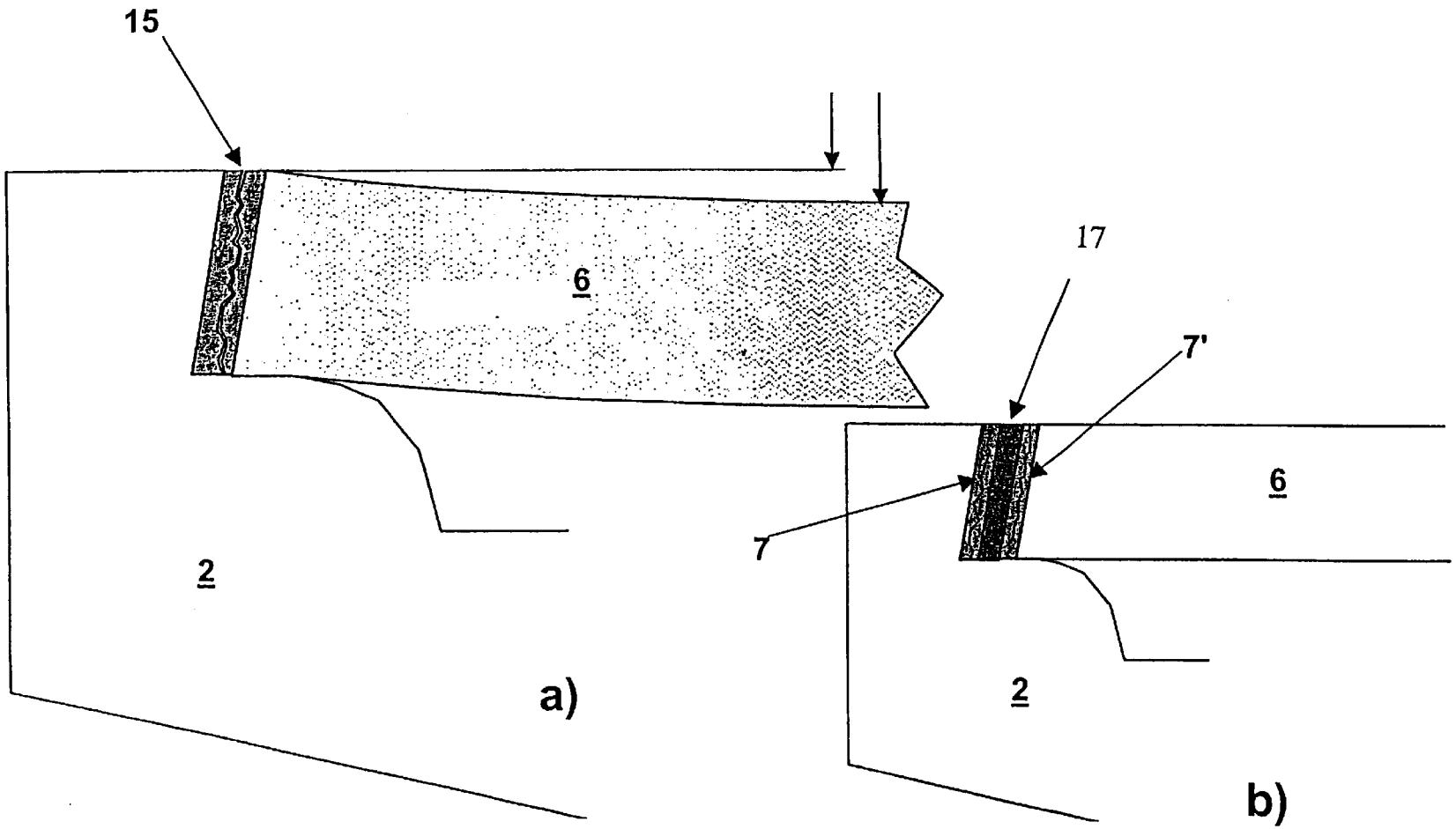

If a gas turbine blade constructed in this manner is taken into operation, tears form along the soldering joint 7 because of the existing brittleness and vibrations. FIG. 3*a* shows such a tear 15 composed of two zig-zag-shaped break surfaces that face each other directly. Since the course of the tear takes on a statistical progression and therefore has break surface sections along the break surfaces that are angled with respect to the radial direction of the gas turbine blade, and therefore to the centrifugal forces acting on the gas turbine blade, a close meshing between the cover plate 6 and the shroud along the soldering joint helps to prevent the cover plate 6 from being able to detach from the shroud 2. In addition, the loose, multi-cornered shape-mated connection permits a seat of the cover plate 6 free of bending stresses inside the shroud, so that the cover plate 6 is exposed to smaller mechanical tensions and vibrations.

FIG. 3*b* shows a joint variation using an additional closing strip 17 that is soldered on both sides with two soldering joints 7, 7'. The closing strip 17 is made from a high-temperature-resistant material that has a much higher ductility than the soldering material itself, so that the closing strip 17 helps to produce a vibration dampening of the cover plate 6 inside the shroud 2.

Figure 4:
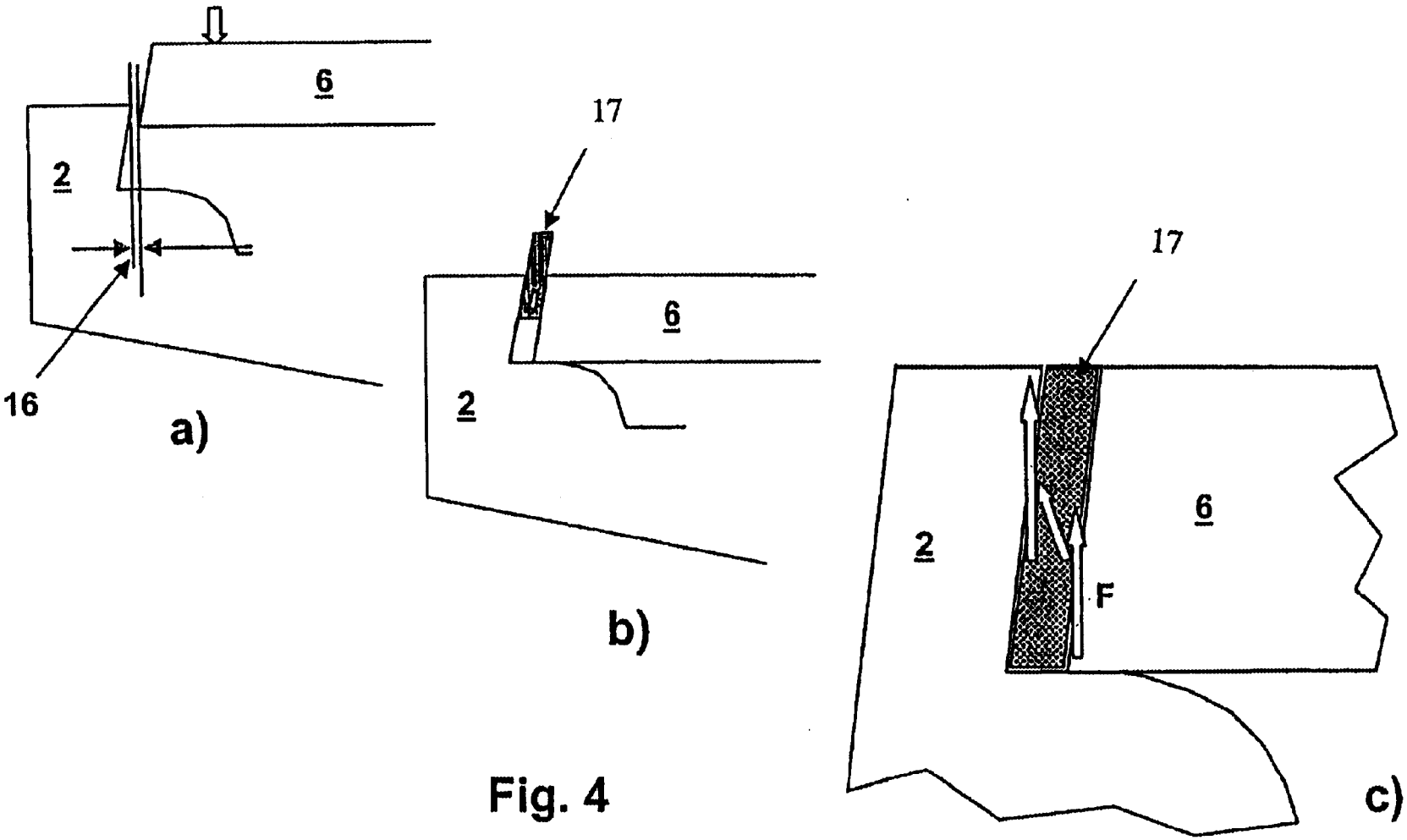
FIGS. 4*a* to *c* show a shape-mated connection using an inserted part, FIGS. 5*a,b,c* show an illustration of alternative joint geometries.

FIG. 4*a* illustrates the insertion process of the cover plate 6 in the receptacle contour of the shroud 2. An installation play 16 between the shroud 2 and the cover plate 6 ensures an unhindered radial insertion of the cover plate 6 on the shroud 2. The closing piece 17 has a sufficiently high ductility as well as high-temperature resistance to be able to transfer the forces occurring between the cover plate 6 and the shroud 2 without damage. FIG. 4*c* shows the progression of the forces between the cover plate 6, the closing piece 17, and the shroud 2. Because of the longitudinal gap extension oriented at an angle to the radial direction, the force vectors, indicated by arrows in FIG. 4*c*, act on the closing piece 17 in such a way that the closing piece 17 prevents the cover plate 6 from detaching radially from the shroud 2.

Figure 5:
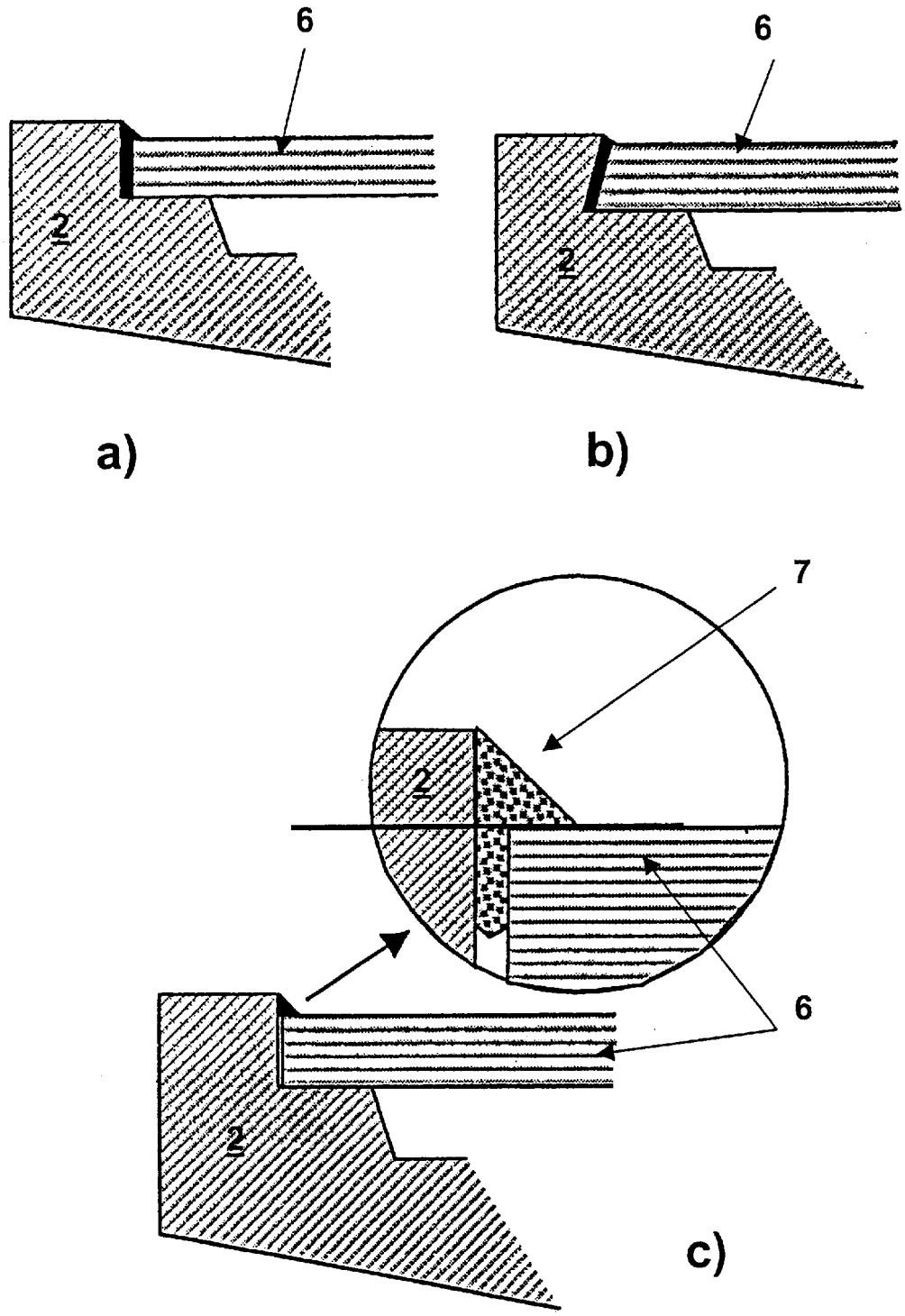

FIGS. 5*a, b* and *c* show different exemplary embodiments for shape-mated connection between the cover plate 6 and the shroud 2. In FIG. 5*a*, a radially-oriented gap between the shroud 2 and the cover plate 6 is filled with soldering material. FIG. 5*b* shows a soldering gap angled radially. In FIG. 5*c*, the gap between cover plate 6 and shroud 2 is constructed radially, and a wedge-shaped soldering point 7 is inserted only in the upper area. The shroud 2 hereby slightly projects beyond the cover plate 6 so that a triangular soldering wedge 7 is able to form between the shroud 2 and the cover plate 6. Studies have shown that with such a wedge-shaped soldering joint 7, a tear forms in such a way as to extend at an angle of approximately 45° in relation to the radial direction, and in this way helps to create a stable shape-mated connection between the cover plate 6 and the shroud 2.

All of the previously mentioned exemplary embodiments with a soldering joint in which a tear forms have in common that the shape-mated connection is based on the close meshing of the tear line-that forms in a zig-zag shape.

Figure 6:
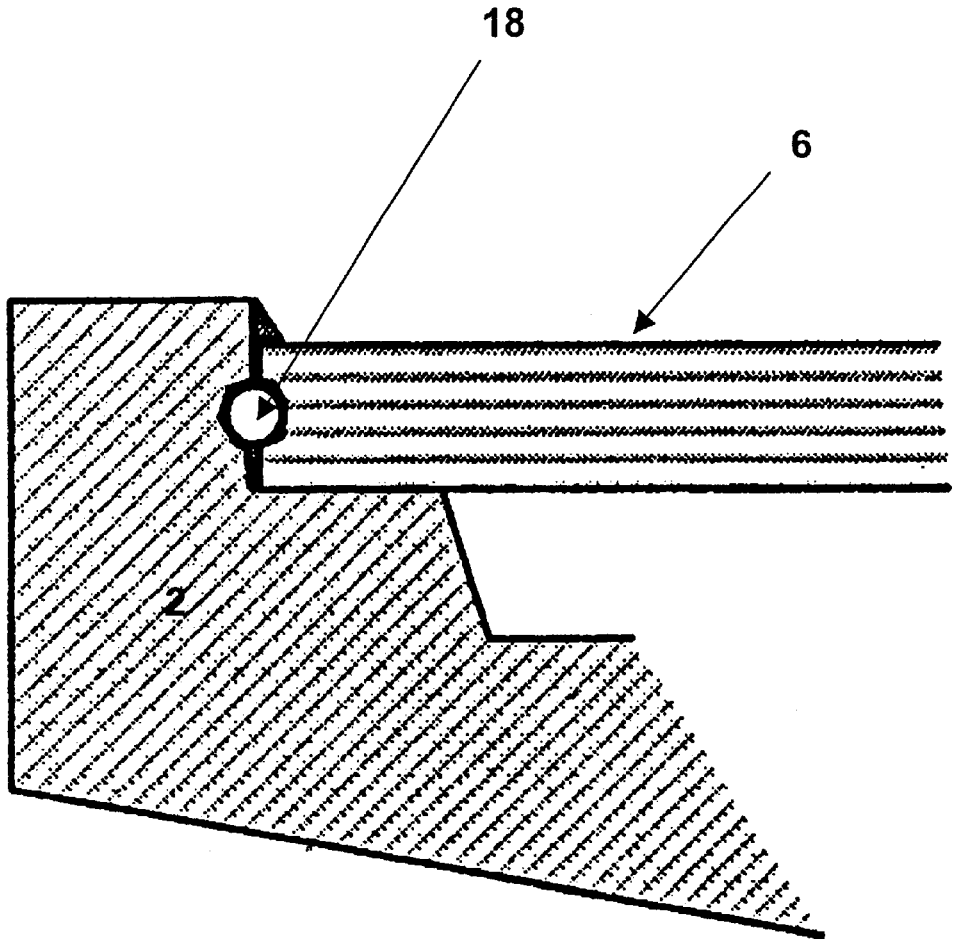
FIG. 6 shows an illustration of shape-mated connections by means of mechanical retention means.

Alternatively or in combination with the aforementioned joint connection, the use of a mechanical retention means between cover plate and shroud may help in creating a shape-mated connection that is stable over the long term and secure. In this context, FIG. 6 shows a corresponding connection cross-section between the cover plate 6 and the shroud 2. Between the shroud 2 and the cover plate 6, a retainer ring 18 is inserted, which projects on both sides partially into the circumferential edge of the cover plate 6, as well as into the shroud 2. Alternatively to using a retainer ring 18, rod-shaped form bodies can be provided, which can be inserted through lateral mounting openings in the shroud and in the cover plate.

What is claimed is:

1. A cooled gas turbine blade with a shroud in which a cooling channel system is provided, which is closed off radially to the gas turbine blade with a cover plate, wherein the cover plate has a circumferential edge, along the entire extension of which the cover plate enters into a plurality of locally limited shape-mated connections with the shroud.

2. The cooled gas turbine blade according to claim 1, wherein the plurality of locally limited shape-mated connections are distributed evenly along the circumferential edge.

3. The cooled gas turbine blade according to claim 1, wherein the shroud has a receptacle contour adapted according to the shape and size of the circumferential edge of the cover plate, having a stepped cross-section provided with a radially or oblique radially-oriented first and an axially-oriented second stage surface, the so-called support surface, and in which the cover plate can be set radially onto the support surface, and that in the area between the first stage surface and the circumferential edge of the cover plate a retention means is provided that ensures the shape-mated connection.

4. The cooled gas turbine blade according to claim 3, wherein a gap is provided between the first stage surface and the cover plate set into the receptacle contour.

5. The cooled gas turbine blade according to claim 4, wherein the first stage surface and the circumferential edge are formed in a straight line and that the gap has a largely constant gap width, and that the gap is oriented radially or oblique radially to the longitudinal direction of the gas turbine blade.

6. The cooled gas turbine blade according to claim 3, wherein the retention means is a joining means that is provided in an area between the first stage surface and the circumferential edge of the cover plate and enters into a close joint connection with both the first stage surface and the circumferential edge, and that within the joining means, along the extension of both joint connections, at least one break surface extending completely through the joining means is provided and has break surface sections extending at an angle to the radial direction.

7. The cooled gas turbine blade according to claim 6, wherein the joining means is a soldering material that has no ductility or only little ductility.

8. The cooled gas turbine blade according to claim 3, wherein the dimensions of the first stage surface are such that it projects beyond the cover plate set into the receptacle contour, that the joining means is provided at least above the cover plate between the cover plate and the first stage surface projecting beyond the cover plate, and that the break surface extends through the joining means radially at an angle.

9. The cooled gas turbine blade according to claim 8, wherein the break surface extends at an angle range of approximately 45° with respect to the cover plate.

10. The cooled gas turbine blade according to claim 3, wherein the circumferential edge of the cover plate has a mounting contour extending along the circumferential edge, into which mounting contour a mechanical retention means can be inserted, and that along the first stage surface a mounting contour corresponding to the mounting contour of the cover plate is provided, with which the mechanical retention means meshes inside the receptacle contour in a force-derived manner in the joined state of the cover plate.

11. The cooled gas turbine blade according to claim 10, wherein the mechanical retention means is a type of retainer ring provided in the mounting contour of the cover plate.

12. The cooled gas turbine blade according to claim 10, wherein the mechanical retention means includes a plurality of rod-shaped form bodies that can be inserted into the mounting contour through lateral mounting openings in the shroud between the circumferential edge of the cover plate and the first stage surface.

13. A cooled gas turbine blade with a shroud in which a cooling channel system is provided, which is closed off radially to the gas turbine blade with a cover plate, wherein the cover plate has a circumferential edge, along the entire extension of which the cover plate enters into a plurality of locally limited evenly distributed shape-mated connections with the shroud.

* * * * *